US009528792B1

(12) United States Patent
Chang

(10) Patent No.: US 9,528,792 B1
(45) Date of Patent: Dec. 27, 2016

(54) CROSSBOW

(71) Applicant: Combis Sport Enterprise Co., Ltd., Taichung (TW)

(72) Inventor: Chu-Wei Chang, Taichung (TW)

(73) Assignee: COMBIS SPORT ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 15/140,480

(22) Filed: Apr. 28, 2016

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12
See application file for complete search history.

(56) References Cited

U.S. PATENT DOCUMENTS 3,670,711 A * 6/1972 Firestone ..... F41B 5/12 124/25
4,258,689 A * 3/1981 Barnett ..... F41B 5/12 124/25
4,719,897 A * 1/1988 Gaudreau ..... F41B 5/1469 124/25
4,827,894 A * 5/1989 Schallberger ..... F41B 5/12 124/25
5,215,069 A * 6/1993 Liu ..... F41B 5/12 124/25

* cited by examiner

*Primary Examiner* — John Ricci

(57) ABSTRACT

A crossbow includes an elongated body, a wing transversely provided on a front portion of the elongated body, a string connected to the wing at two ends, a trigger pivotally connected to the elongated body, and a pull turner assembly operable to pull the string. The pull turner assembly includes two pull turners, a crossbar and a lever. Each pull turner includes a front end and a rear end, and is moveable near and along a lateral face of the elongated body in parallel. The front ends of the pull turners pull the string while the pull turners are moved rearwards. The crossbar is connected to the front ends of the pull turners and movable along an upper face of the elongated body. The lever is connected to the rear ends of the pull turners and operable to move the pull turners to and fro along the elongated body.

8 Claims, 5 Drawing Sheets

CROSSBOW

BACKGROUND OF INVENTION

1. Field of Invention

The present invention relates to a crossbow and, more particularly, to a pull turner assembly of a crossbow.

2. Related Prior Art

As disclosed in Taiwanese Patent No. 207344 for example, a typical crossbow includes an elongated body 10, a wing (not shown) transversely connected to a front portion of the elongated body 10, a string (not shown) connected to the wing at two ends, a pull turner 14 supported on the elongated body 10, and a trigger 16 connected to the elongated body 10. The pull turner 14 is operable to pull the string to a tight, stressed or loaded status. The trigger 16 is operable to lock or release the string. The pull turner 14 is a substantially U-shaped element made by bending a rigid wire. The pull turner 14 includes two branches each including a crook end 141 for hooking the string.

The use of this typical crossbow is not without any problem. Firstly, each of the branches of the pull turner 14 is located next to a corresponding one of two sides of the elongated body 10. There is no element to position the crook ends 141 of the pull turner 14 when the pull turner 14 is moved along the elongated body 10 to pull the string so that the crook ends 141 tend to bend and rub against the elongated body 10. Such rubbing inevitably wears away the elongated body 10 and the pull turner 14, and imposes an extra load on a user. Secondly, the user can load a bolt and pull the trigger 16 to release the string to project the bolt without encountering any interference before the pull turner 14 is returned to its original position. This jeopardizes the safety of the user and nearby people.

The present invention is therefore intended to obviate or at least alleviate the problems encountered in prior art.

SUMMARY OF INVENTION

It is the primary objective of the present invention to provide a reliable and secure crossbow.

To achieve the foregoing objective, the crossbow includes an elongated body, a wing transversely provided on a front portion of the elongated body, a string connected to the wing at two ends, a trigger pivotally connected to the elongated body, and a pull turner assembly operable to pull the string. The pull turner assembly includes two pull turners, a crossbar and a lever. Each of the pull turners includes a front end and a rear end, and is moveable near and along a lateral face of the elongated body in parallel. The front ends of the pull turners pull the string while the pull turners are moved rearwards. The crossbar is connected to the front ends of the pull turners and movable along an upper face of the elongated body. The lever is connected to the rear ends of the pull turners and operable to move the pull turners to and fro along the elongated body.

It is an advantage of the present invention to guide and hence keep the front ends of the pull turners from rubbing against the elongated body. Hence, the front ends of the pull turners do not wear away the elongated body. Hence, there is no extra friction working against the loading of the string. That is, no extra load is imposed on a user during the loading of the string. Similarly, there is no extra friction working against the releasing of the string.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
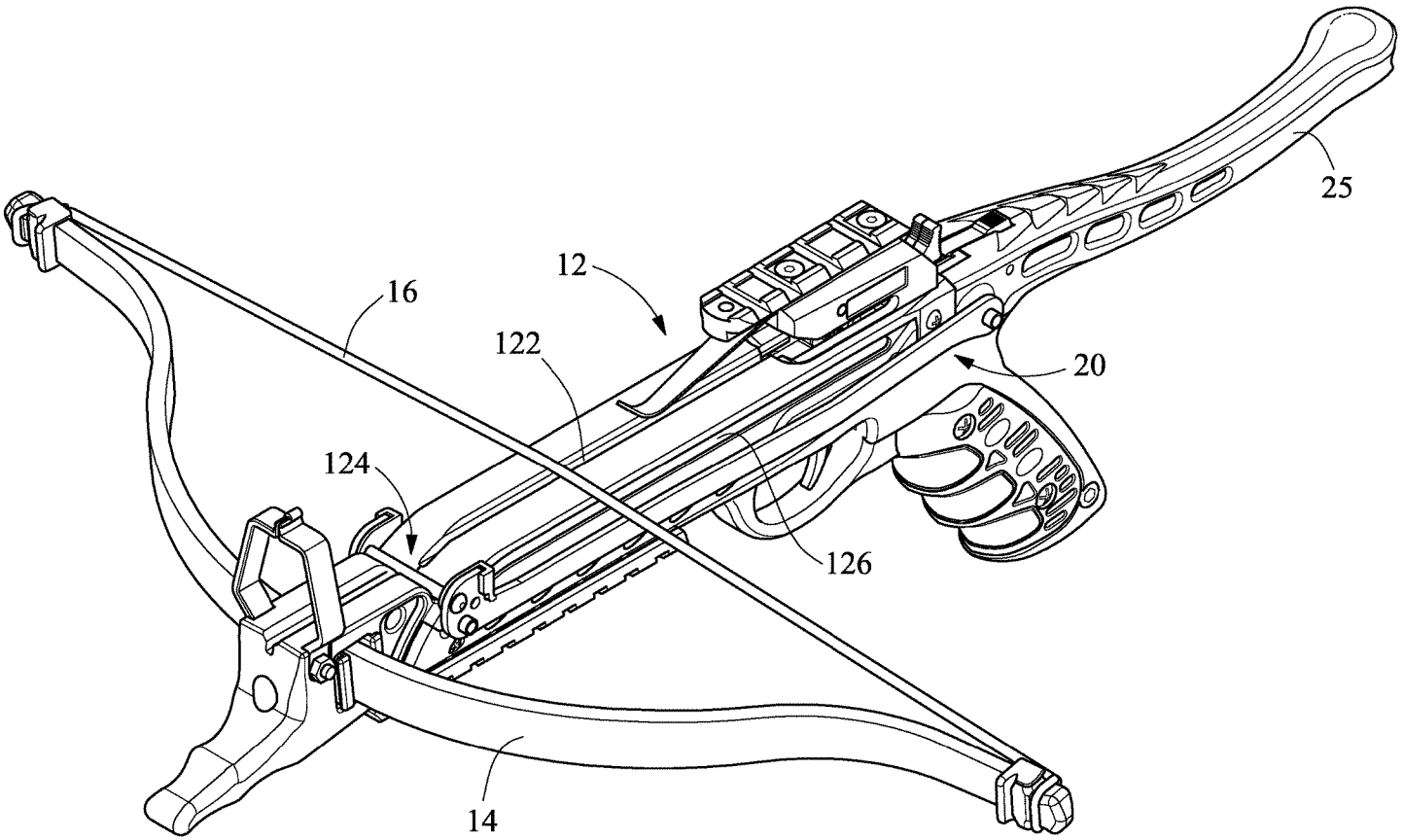
FIG. 1 is a perspective view of a crossbow according to the preferred embodiment of the present invention.
Figure 2:
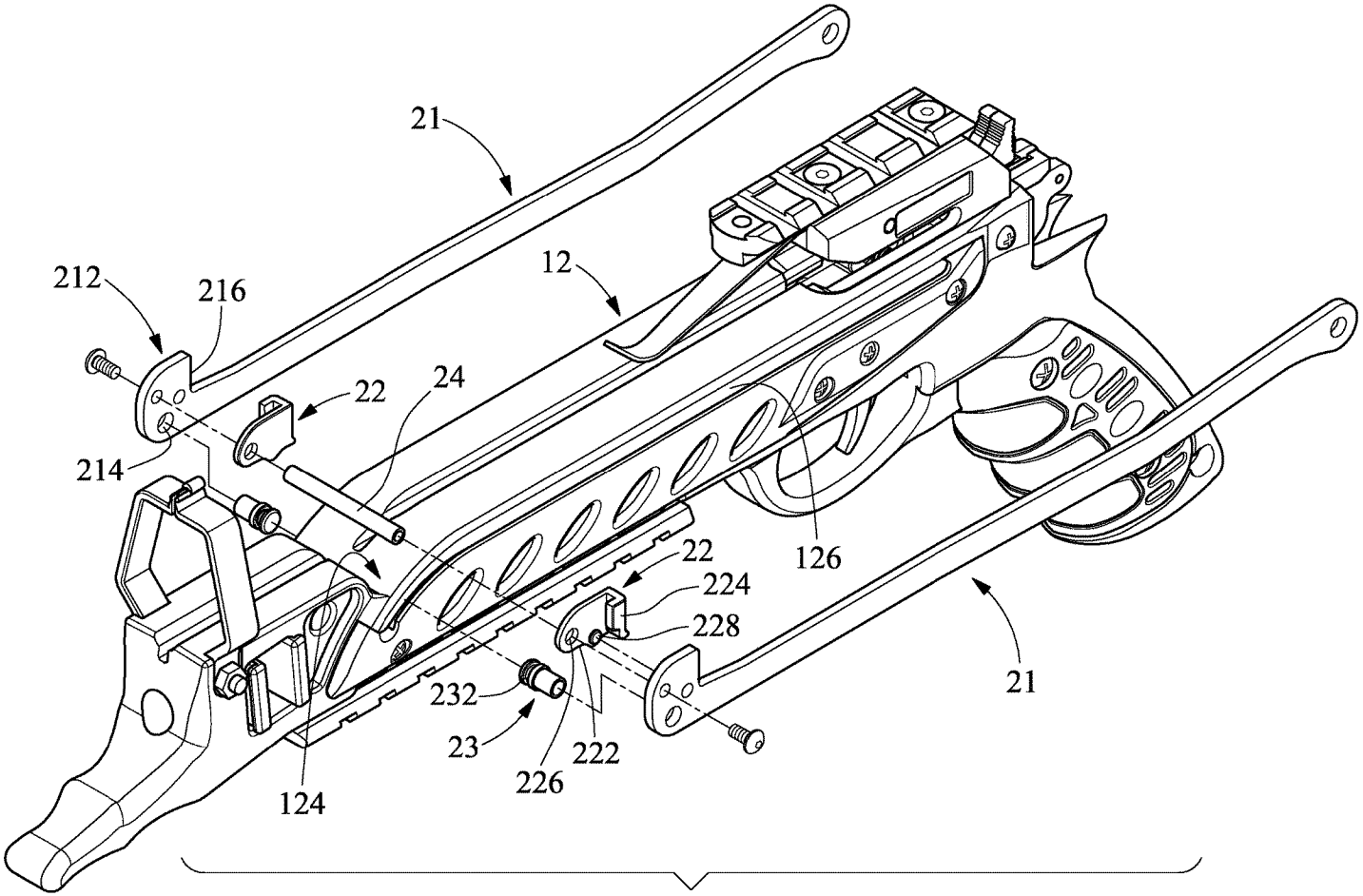
FIG. 2 is an exploded view of the crossbow shown in FIG. 1.
Figure 3:
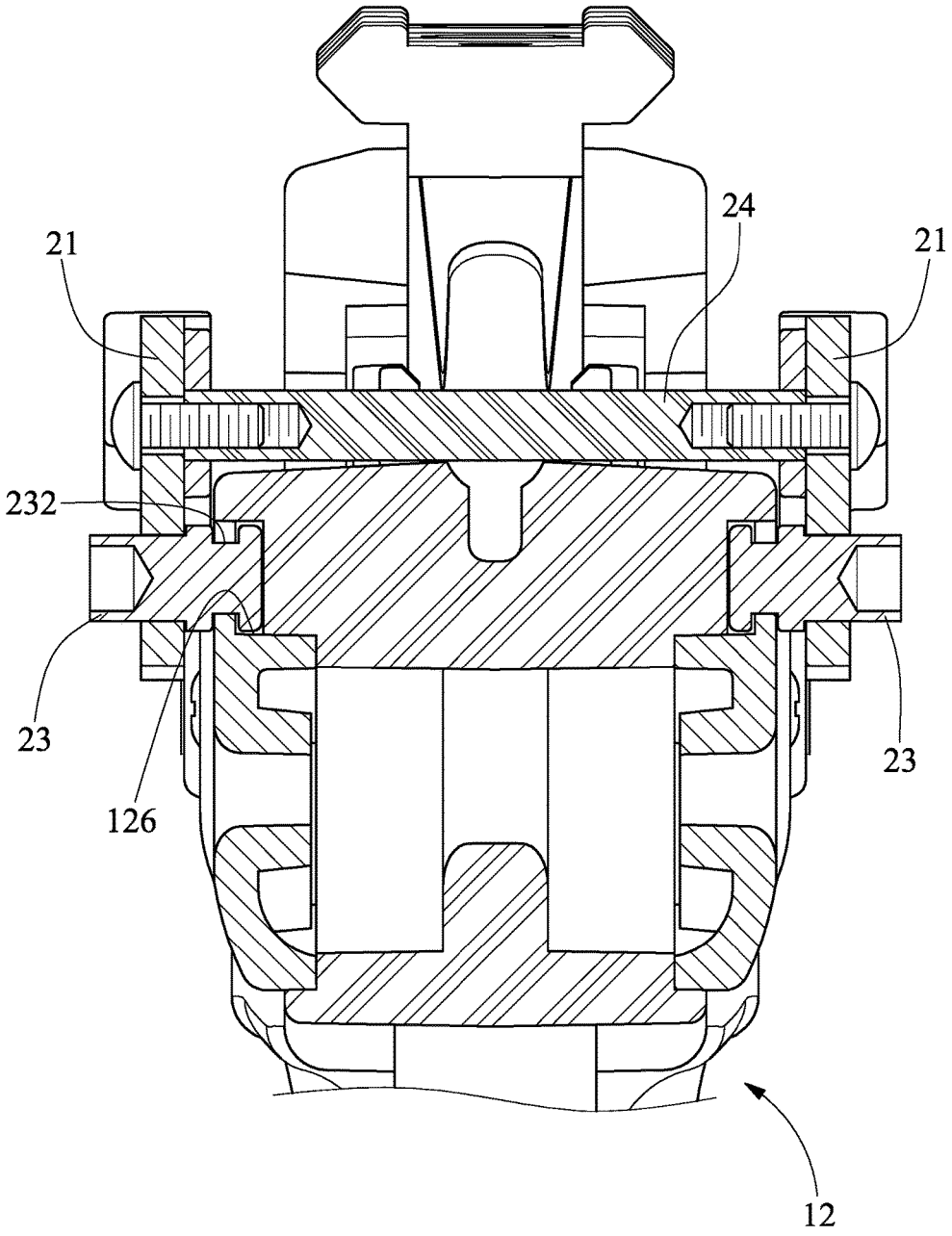
FIG. 3 is a cross-sectional view of the crossbow shown in FIG. 1.
Figure 4:
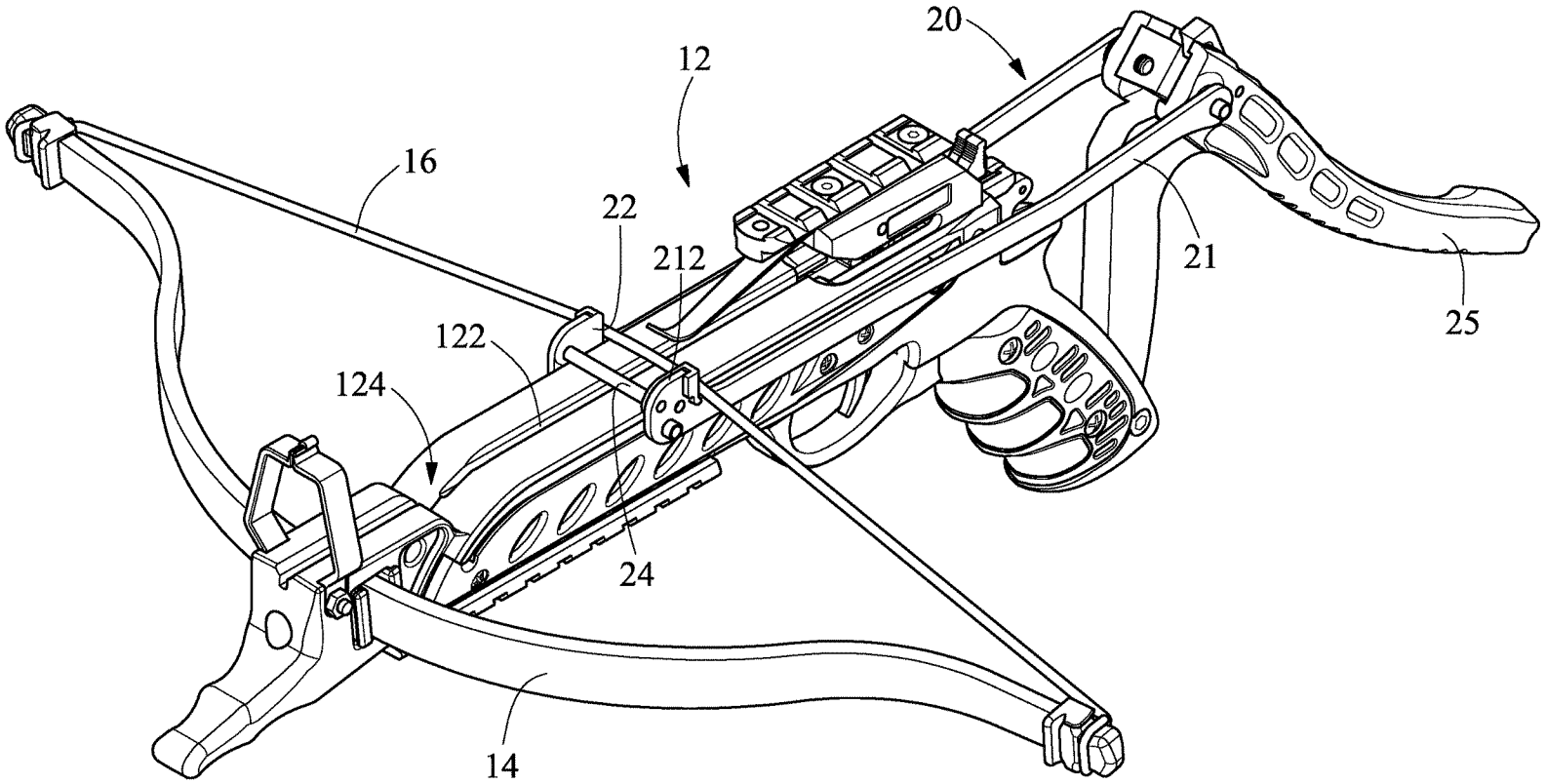
FIG. 4 is a perspective view of the crossbow in another position than shown in FIG. 1.
Figure 5:
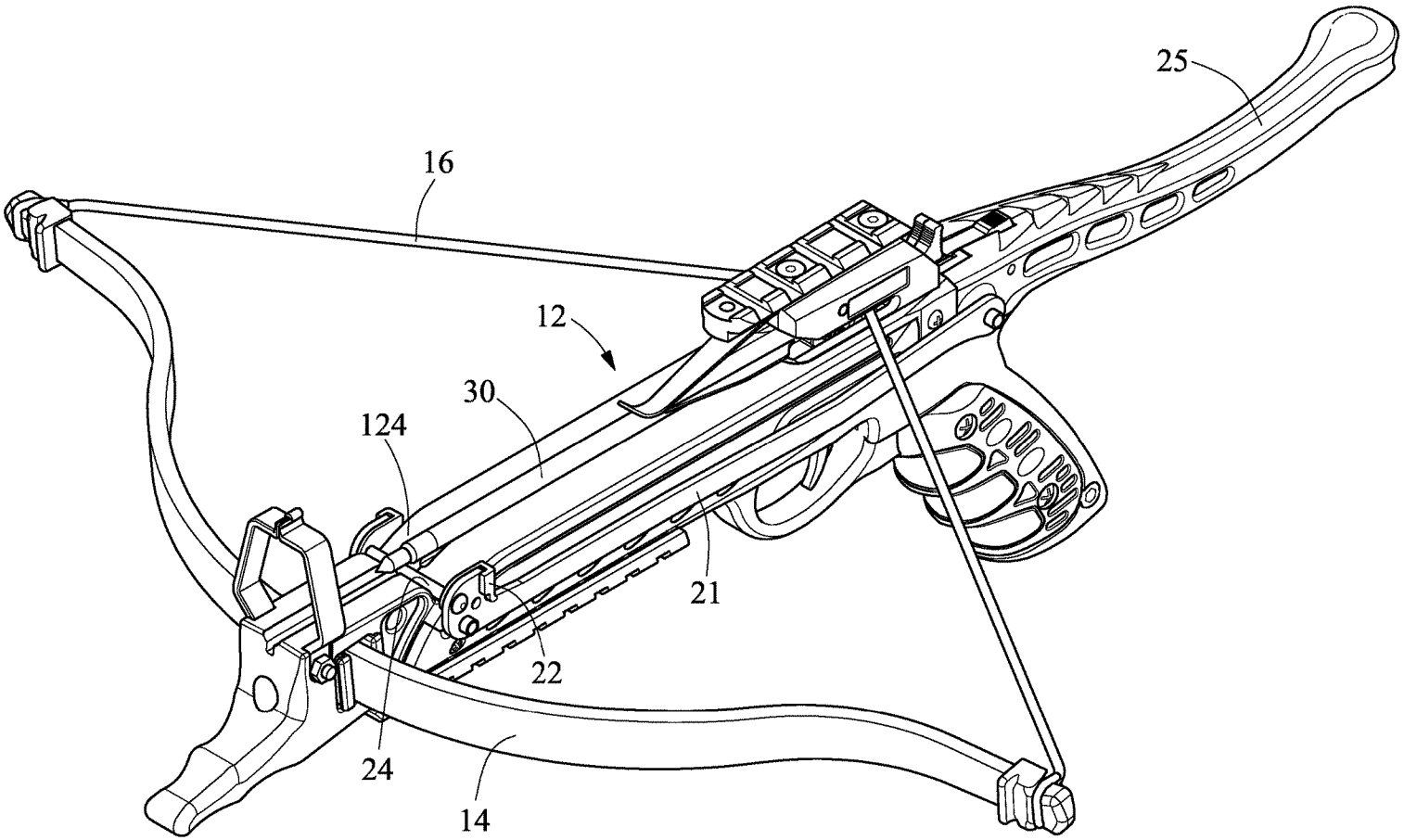
FIG. 5 is a perspective view of the crossbow in another position than shown in FIG. 4.

Referring to FIGS. 1 through 5, a crossbow includes an elongated body 12, a wing 14, a string 16, a trigger 18 and a pull turner assembly 20 according to the preferred embodiment of the present invention. The wing 14 is connected to a front portion of the elongated body 12. The wing 14 extends across the elongated body 12. The string 16 is connected to the wing 14 at two ends. The turner assembly 20 is operable to pull or release the string 16. The trigger 18 is pivotally connected to the elongated body 12 and operable for locking or releasing the string 16.

The elongated body 12 includes at least one middle groove 122, a recess 124, two lateral grooves 126 and two fins 128. The middle groove 122 and the recess 124 are made in an upper face of the elongated body 12. The middle groove 122 extends along the elongated body 12. The recess 124 is located in the front portion of the elongated body 12. A slope (not numbered) is formed on the front portion of the upper face of the elongated body 12. The slope leads to the recess 124. Each of the lateral grooves 126 is made in a corresponding one of two lateral faces of the elongated body 12. Each of the lateral grooves 126 includes a front portion that descends as it extends forwards. The front portion of each of the lateral grooves 126 extends substantially parallel to the slope. The lateral grooves 126 extend along the elongated body 12. Each of the fins 128 is located next to and extends along a corresponding one of the lateral grooves 126.

The pull turner assembly 20 includes two pull turners 21, two washers 22, two sliding elements 23, a crossbar 24 and a lever 25. The pull turners 21 are located on the lateral faces of the elongated body 12. The pull turners 21 are movable to and fro along the elongated body 12. Each of the pull turners 21 includes a front end formed as a crook end 212, apertures 214 made in the crook end 212, and a vertical edge 216 formed on the crook end 212. The vertical edge 216 extends perpendicular to a substantially horizontal upper edge of each of the pull turners 21. The crook end 212 of each of the pull turners 21 is adapted for pulling the string 16 when the pull turner 21 is moved rearwards.

Each of the washers 22 is located next to the crook end 212 of a corresponding one of the pull turners 21 to keep the crook end 212 of each of the puller turners 21 away from the elongated body 12. Each of the washers 22 includes a longitudinal shield 222, a transverse shield 224, an aperture 226 and a positioning boss 228. The longitudinal shield 222 extends perpendicular to the transverse shield 224. The longitudinal shield 222 and the transverse shield 224 are made in one piece. The longitudinal shield 222 of each washer 22 partially covers the crook end 212 of the corresponding pull turner 21. The transverse shield 224 of each washer 22 partially covers the vertical edge 216 of the corresponding pull turner 21. The aperture 226 is made in the washer 22 corresponding to one of the apertures 214 of the crook end 212 of the corresponding pull turner 21. The positioning boss 228 is formed on the longitudinal shield 222. The positioning boss 228 of each washer 22 is inserted in a corresponding one of the apertures 214 in the crook end 212 of the corresponding pull turner 21.

Each of the sliding elements 23 includes an annular groove 232 for receiving a corresponding one of the fins 128 when a first end thereof is inserted in a corresponding one of the lateral grooves 126. A second end of each of the sliding elements 23 is inserted in a corresponding one of the apertures 214 of the crook end 212 of a corresponding one of the pull turners 21. The first end of each sliding element 23 is movable in and along the corresponding lateral groove 126 to keep the corresponding pull turner 21 smoothly moving along the elongated body 12. Thus, the pull turners 21 are kept from rubbing against or wearing away the elongated body 12.

The crossbar 24 is provided across the elongated body 12 and formed with two ends each connected to the crook end 212 of a corresponding one of the pull turners 21 by a screw (not numbered). Thus, the pull turners 21 cannot be bent toward or from each other. The elongated body 12 is normally located in the recess 124.

The lever 25 is connected to a rear end of each of the pull turners 21. Preferably, the lever 25 is pivotally connected to the elongated body 12. Thus, the lever 25 can be pivoted to move the pull turners 21. However, in another embodiment, the lever 25 can be replaced with a handle such as that of the pull turner 141 disclosed in Taiwanese Patent No. 207344. In such a case, the handle is pulled, instead of pivoted, to move the pull turners 21.

The operation of the pull turner assembly 20 of the crossbow will be described. The lever 25 is pivoted to move the pull turners 21 rearwards to allow the crook ends 212 to pull the string 16. Thus, the string 16 is loaded. Then, the string 16 is locked by the trigger 18, keeping the loaded status of the string 16. The pull turners 21 are moved forwards after the string 16 is locked by the trigger 18. Then, the crossbar 24 is inserted in the recess 124 of the elongated body 12. Finally, a bolt 30 is inserted in the middle groove 124 of the elongated body 12. An end of the bolt 30 is pointed forwards while a tail of the bolt 30 is located against the string 16. Now, the trigger 18 is ready for pivoting to release the string 18 to shoot the bolt 30.

During the movement of the pull turners 21, the sliding elements 23 are synchronously moved along the elongated body 12 while the first ends thereof are moved in and along the lateral grooves 126. During the movement, the crook ends 212 of the pull turners 21 are positioned by the crossbar 24 and guided by the sliding elements 23 of which the first ends are moved in and along the lateral grooves 126 of the elongated body 12. Thus, the pull turners 21 extend parallel to each other while moving along the elongated body 12.

Advantageously, the crook ends 212 of the pull turners 21 do not rub against or wear away the elongated body 12. Hence, there is no extra friction working against the loading of the string 16. That is, no extra load is imposed on a user during the loading of the string 16. Similarly, there is no extra friction working against the releasing of the string 16. Moreover, the crossbar 24 is normally inserted in the recess 124 of the elongated body 12. Thus, the crossbar 24 and the crook ends 216 of the pull turners 21 do not interfere with the loading or shooting of the bolt 30.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A crossbow comprising an elongated body (12) formed with an upper face and two lateral faces, a wing (14) transversely provided on a front portion of the elongated body (12), a string (16) connected to the wing (14) at two ends, a trigger (18) pivotally connected to the elongated body (12), and a pull turner assembly (20) operable to pull the string (16), characterized in that the pull turner assembly (20) comprises:

two pull turners (21) each made with a front end (212) and a rear end and moveable near and along a lateral face of the elongated body (12) in parallel, wherein the front ends (212) of the pull turners (21) pull the string (16) while the pull turners (21) are moved rearwards;

a crossbar (24) connected to the front ends (212) of the pull turners (21) and movable along an upper face of the elongated body (12); and a lever (25) connected to the rear ends of the pull turners (21) and operable to move the pull turners (21) to and fro along the elongated body (12).

2. The crossbow according to claim 1, wherein the elongated body (12) further comprises a recess (124) in a front portion thereof for receiving the crossbar (24).

3. The crossbow according to claim 2, wherein the elongated body (12) further comprises two lateral grooves (126) each made in a corresponding one of the lateral faces thereof and adapted for receiving a portion of a corresponding one of the pull turners (21).

4. The crossbow according to claim 3, wherein the pull turner assembly (20) further comprises two sliding elements (23) each comprising an end connected to a corresponding one of the pull turners (21) and another end movable in and along a corresponding one of the lateral grooves (126).

5. The crossbow according to claim 4, wherein each of the sliding elements (23) comprises an annular groove (232), wherein the elongated body (12) further comprises two fins (128) each inserted in the annular groove (232) of a corresponding one of the sliding elements (23).

6. The crossbow according to claim 4, wherein the pull turner assembly (20) further comprises two washers (22) each sandwiched between a corresponding one of the pull turners (21) and the second end of a corresponding one of the sliding elements (23).

7. The crossbow according to claim 6, wherein the front end (212) of each of the pull turners (21) is a crook end (212) for hooking the string (16).

8. The crossbow according to claim 7, wherein each of the washers (22) comprises:

a longitudinal shield (222) sandwiched between the crook end (212) of the corresponding pull turner (21) and the second end of the corresponding sliding element (23);

a transverse shield (224) for covering a vertical edge (216) of the corresponding pull turner (21); and a positioning boss (228) inserted in an aperture (214) made in the crook end (212) of the corresponding pull turner (23).

* * * * *